US005931061A

United States Patent [19]

Kuo

[11] Patent Number: 5,931,061

[45] Date of Patent: Aug. 3, 1999

[54] GUN SHAPE DRIVING TOOL

[76] Inventor: Ying Hong Kuo, 4F, No. 37, Lane 113, Tunghu Rd. Neihu Dist., Taipei, Taiwan

[21] Appl. No.: 09/008,459

[22] Filed: Jan. 16, 1998

[51] Int. Cl.[6] ..... B25B 17/00

[52] U.S. Cl. ..... 81/57.29; 81/57.22; 81/58.1; 81/490

[58] Field of Search ..... 81/57.29, 58.1, 81/57.22, 490

[56] References Cited

U.S. PATENT DOCUMENTS 4,603,606 8/1986 Headen .

*Primary Examiner*—Timothy V. Eley
*Assistant Examiner*—Sinclair Skinner

[57] ABSTRACT

A driving tool includes a barrel having a front hole and having a rear handle inclined relative to the barrel for forming a gun-shaped tool and for allowing the user to easily hold the driving tool and to easily apply a force against the driving tool. A driving stem is rotatably engaged in the hole of the barrel for engaging with a tool bit. A hand grip is coupled to the driving stem via bevel gears for rotating the driving stem. A cartridge is rotatably engaged in the barrel and has a ratchet mechanism for controlling the actuating directions of the driving stem.

6 Claims, 4 Drawing Sheets

GUN SHAPE DRIVING TOOL

BACKGROUND OF THE INVENTION

1. Field of the Invention

The present invention relates to a tool, and more particularly to a gun shape driving tool.

2. Description of the Prior Art

Typical driving tools, such as wrenches and screw drivers, comprise a handle and a driving stem that is normally in line with the handle such that the user may not apply a great force to the driving stem via the handle.

The present invention has arisen to mitigate and/or obviate the afore-described disadvantages of the conventional driving tools.

SUMMARY OF THE INVENTION

The primary objective of the present invention is to provide a driving tool which includes a gun shape for allowing the user to apply a great force to the driving stem.

In accordance with one aspect of the invention, there is provided a driving tool comprising a barrel including a front portion having a hole and including a rear portion having a handle extended therefrom, the handle being inclined relative to the barrel for forming a gun-shaped body, a driving stem rotatably engaged in the hole of the barrel for engaging with a tool bit, and means for rotating the driving stem.

A cartridge is rotatably engaged in the hole of the barrel, the driving stem is extended from the cartridge, and the rotating means is provided for rotating the driving stem via the cartridge. The cartridge includes a first bevel gear, the rotating means includes a second bevel gear rotatably engaged in the barrel and engaged with the first bevel gear, and a hand grip secured to the second bevel gear for rotating the cartridge via the bevel gears.

The barrel includes a recess, and a shaft engaged in the recess, the shaft is provided for engaging with the driving stem. The handle includes an interior for receiving tool bits. A casing is secured to the barrel and a securing means is provided for securing the casing to the barrel, the casing includes a plurality of orifices for engaging with tool bits. The barrel includes a first engaging member, the casing includes a second engaging member for engaging with the first engaging member and for securing the casing to the barrel. A cover is pivotally secured to the casing for retaining the tool bits in the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
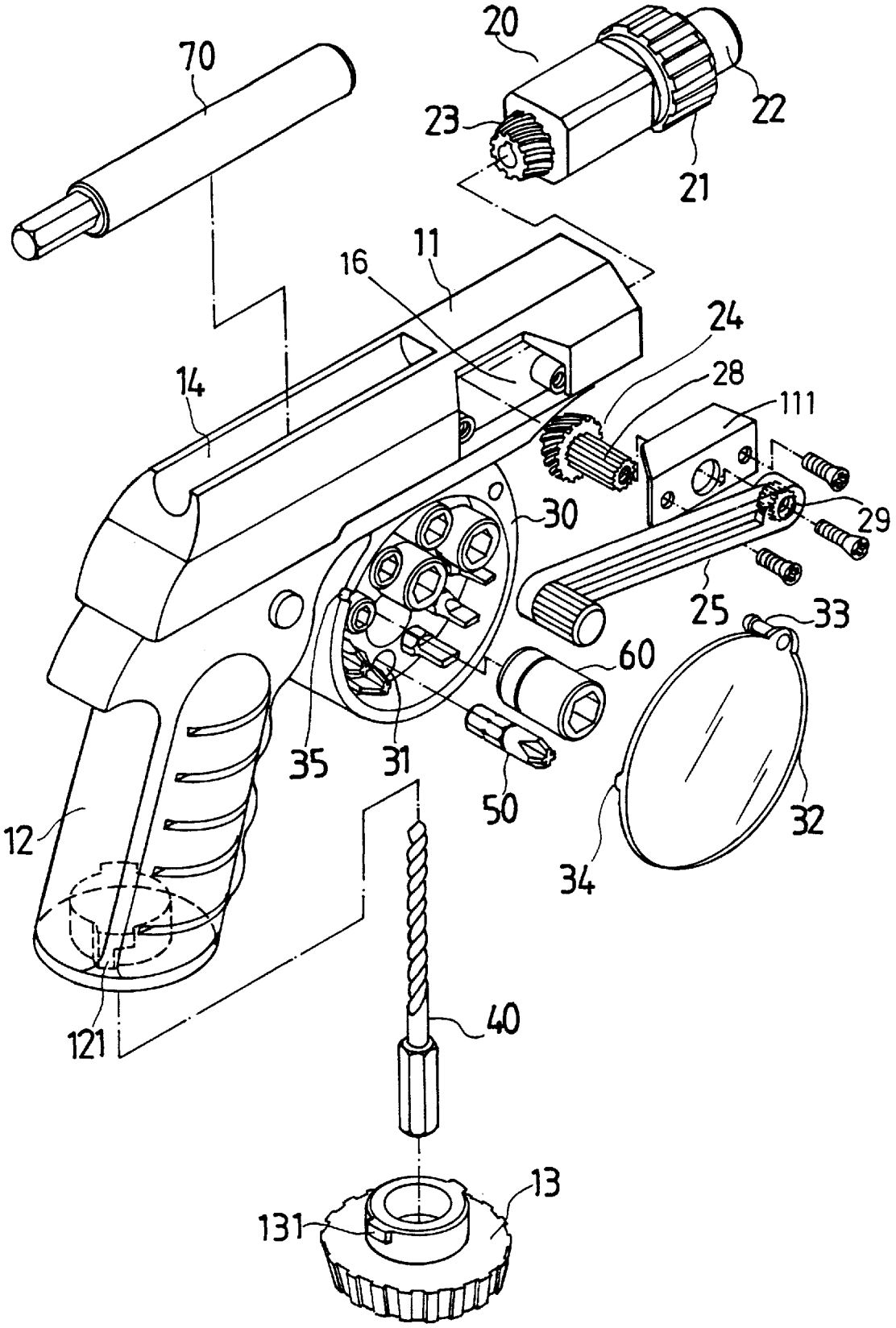
FIG. 1 is an exploded view of a driving tool in accordance with the present invention.
Figure 2:
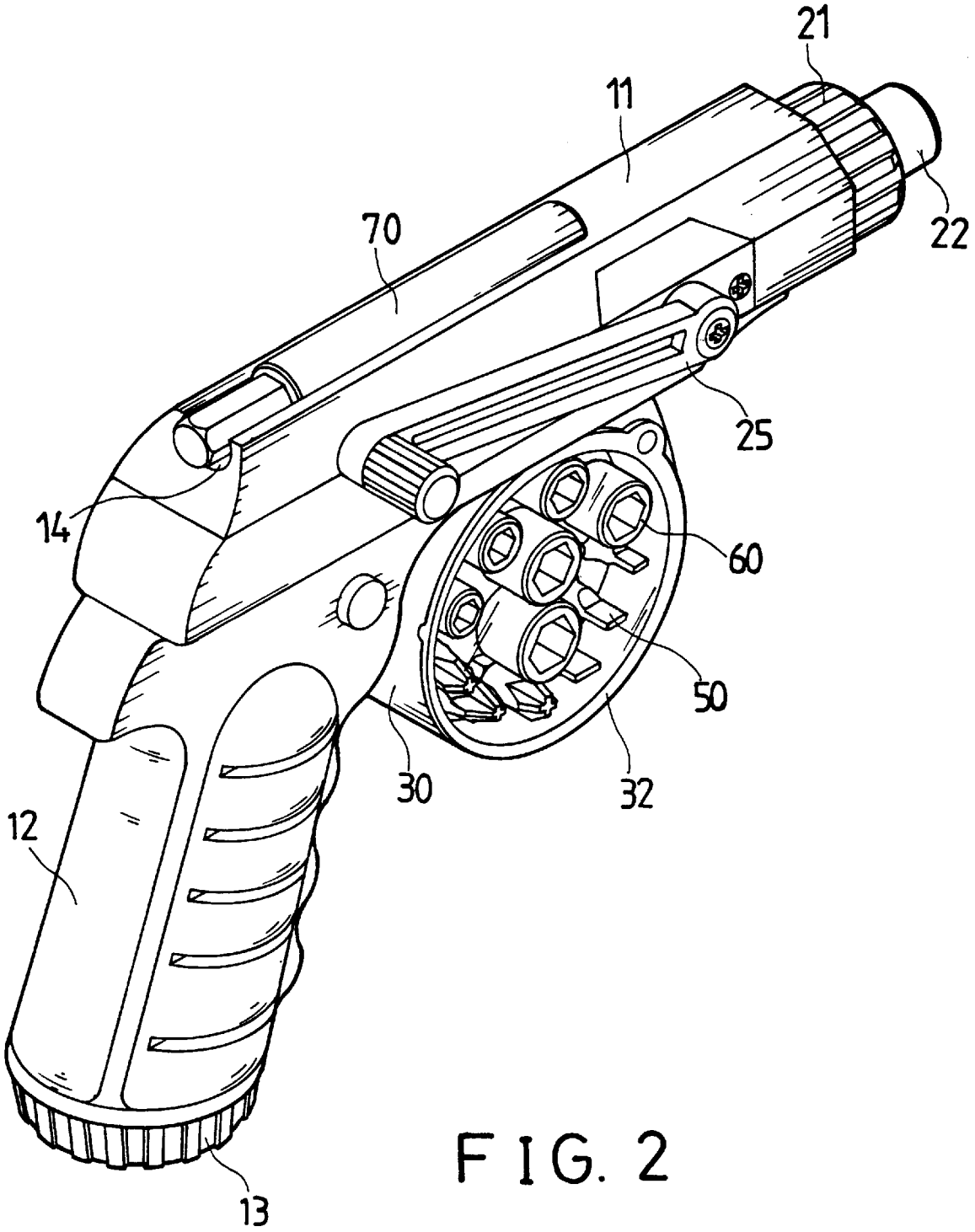
FIG. 2 is a perspective view of the driving tool.

Referring to the drawings, and initially to FIGS. 1 and 2, a driving tool in accordance with the present invention comprises a barrel 11 including a handle 12 extended from the rear end and inclined relative to the barrel 11 for forming a gun-shaped body. The handle 12 includes an interior for receiving tool members, such as the drilling tool bit 40. A cap 13 includes one or more catches 131 for engaging with the notches 121 of the handle 12 and for securing the cap 13 to the handle 12 and for retaining the tool members 40 in the handle 12. The barrel 11 includes a hole 16 formed in the front portion and includes a recess 14 formed in the rear portion for receiving a shaft 70.

Figure 4:
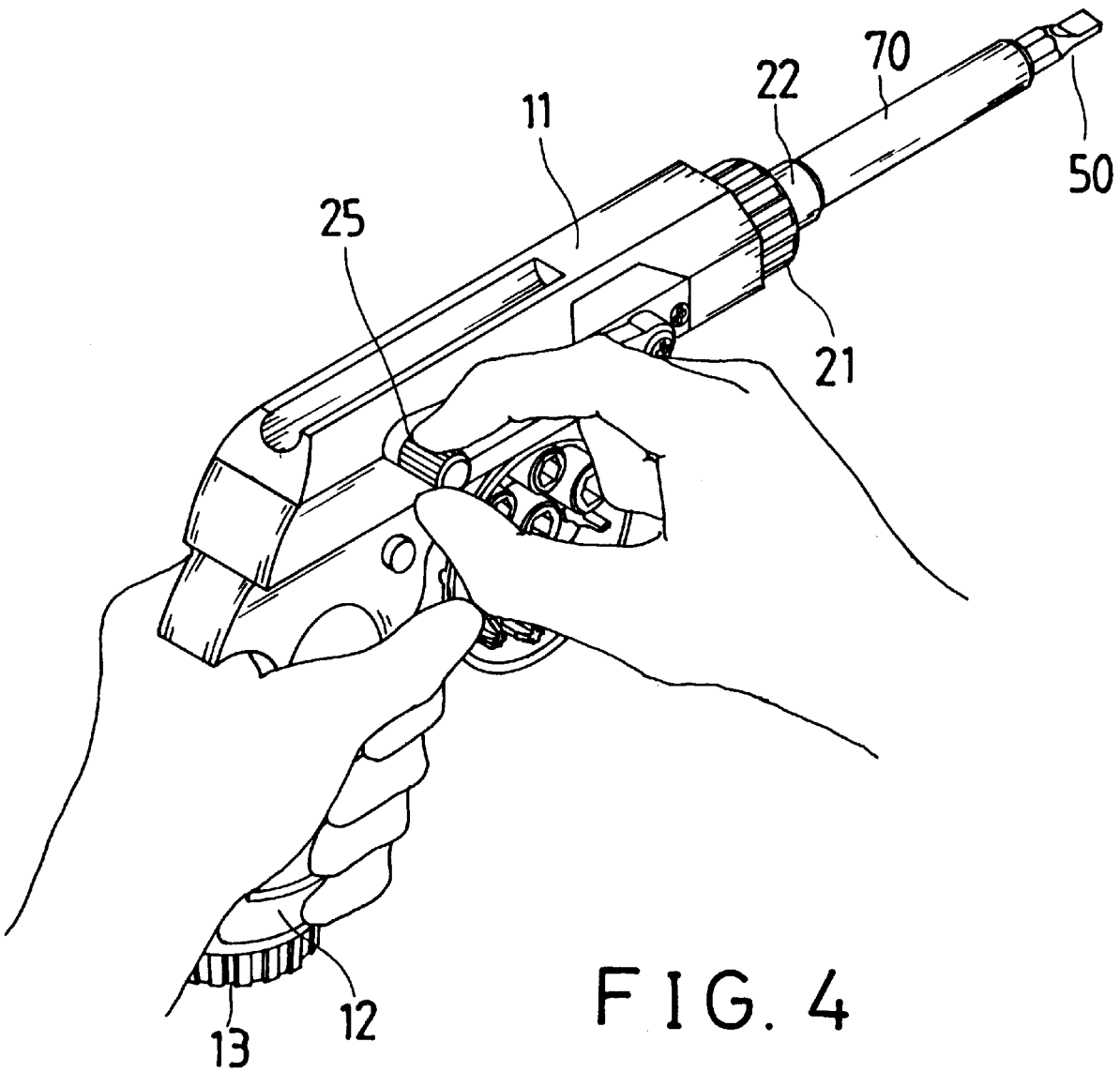
FIG. 4 is a perspective view of the driving tool, illustrating the operation of the driving tool.

A cartridge 20 is rotatably engaged in the hole 16 of the barrel 11 and includes a bevel gear 23 secured to the rear end and includes a driving stem 22 extended forward from the front end of the cartridge 20 for engaging with a tool bit 50 or for engaging with the shaft 70 (FIG. 4). A ratchet control mechanism 21 is disposed in the cartridge 20 and coupled to the driving stem 22 for controlling the driving directions of the driving stem 22. One typical ratchet control mechanism is disclosed in U.S. Pat. No. 4,603,606 to Headen and is taken as a reference for the ratchet control mechanism 21.

Another bevel gear 24 is laterally engaged into the middle portion of the barrel 11 and engaged with the bevel gear 23 of the cartridge 20. The bevel gear 24 includes an axle 28 laterally extended outward of the barrel 11. A hand grip 25 includes an aperture 29 secured to the axle 28 for allowing the hand grip 25 to rotate the cartridge 20 via the bevel gears 24, 23. A lid 111 may be disengaged from the barrel 11 for engaging the bevel gear 24 into the barrel 11.

In operation, as shown in FIG. 4, the left hand, for example, of the user may solidly and easily hold the handle 12 and may apply a great force to the shaft 70 and/or the tool bit 50. The upper portion of the user, particularly the chest, may also force against the handle 12 and/or the barrel 11 for further forcing the driving stem 22 and/or the shaft 70 against the tool bit 50 and the fastener to be driven. The shaft 70 and the tool bit 50 may be easily rotated by the hand grip 25 with the right hand, for example, in order to drive the fastener.

Figure 3:
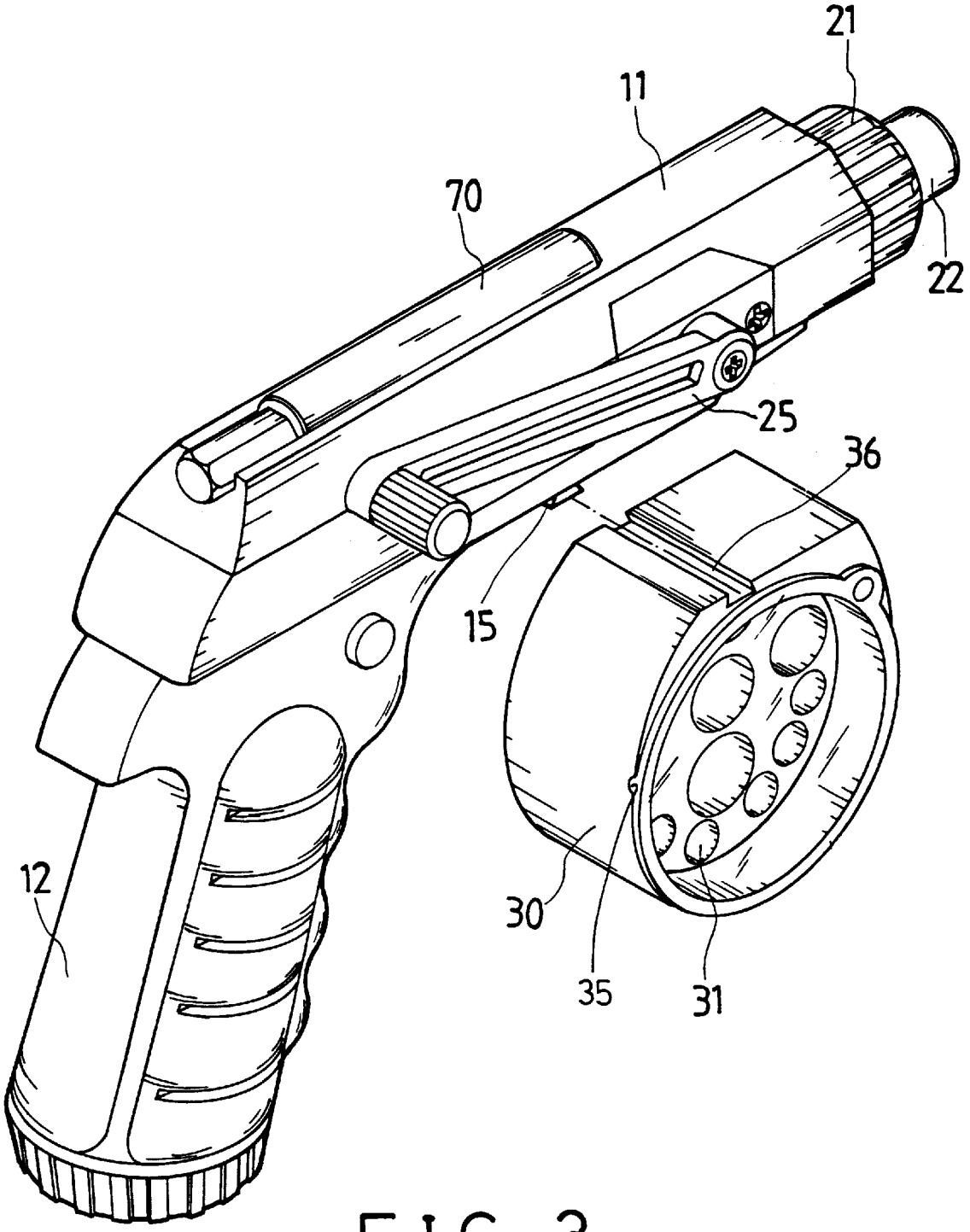
FIG. 3 is a partial exploded view of the driving tool.

Referring next to FIG. 3, and again to FIGS. 1 and 2, the barrel 11 includes an engaging member, such as a dovetail 15 (FIG. 3). A casing 30 includes a corresponding engaging member, such as a dovetail slot 36 for engaging with the dovetail 15 and for allowing the casing 30 to be easily secured to the gun body. The casing 30 includes a number of orifices 31 for engaging with tool bits 50 and/or sockets 60. A cover 32 may be pivotally secured to the casing 30 by a pin 33 and includes a catch 34 for engaging with a depression 35 of the casing 30 and for positioning the cover 32 in place relative to the casing 30 and for allowing the cover 32 to retain the tool bits 50 and the sockets 60 in the casing 30. One or more casings 30 may be provided for receiving tool bits 50 and/or sockets 60 of different sizes and may be easily selected and secured to the gun body when required.

Accordingly, the driving tool includes a gun-shaped body for allowing the user to easily and forcefully actuate the driving tool and includes a hand grip for rotating and actuating the driving stem.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving tool comprising:

a barrel including a front portion having a hole and including a rear portion having a handle extended therefrom, said handle being inclined relative to said barrel for forming a gun-shaped body, said barrel including a first engaging member, a driving stem rotatably engaged in said hole of said barrel for engaging with a tool bit, means for rotating said driving stem, and a casing secured to said barrel and means for securing said casing to said barrel, said casing including a plurality of orifices for engaging with tool bits, and said casing including a second engaging member for engaging with said first engaging member and for securing said casing to said barrel.

2. The driving tool according to claim 1 further comprising a cartridge rotatably engaged in said hole of said barrel, said driving stem being extended from said cartridge, and said rotating means being provided for rotating said driving stem via said cartridge.

3. The driving tool according to claim 2, wherein said cartridge includes a first bevel gear, said rotating means includes a second bevel gear rotatably engaged in said barrel and engaged with said first bevel gear, and a hand grip secured to said second bevel gear for rotating said cartridge via said bevel gears.

4. The driving tool according to claim 1, wherein said barrel includes a recess, and a shaft engaged in said recess, said shaft is provided for engaging with said driving stem.

5. The driving tool according to claim 1, wherein said handle includes an interior for receiving tool bits.

6. The driving tool according to claim 1 further comprising a cover pivotally secured to said casing for retaining the tool bits in said casing.

* * * * *